US008746818B2

(12) United States Patent
Meese

(10) Patent No.: US 8,746,818 B2
(45) Date of Patent: Jun. 10, 2014

(54) BEVERAGE STORAGE RACK

(75) Inventor: David L. Meese, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 54 days.

(21) Appl. No.: 13/517,883

(22) Filed: Jun. 14, 2012

(65) Prior Publication Data

US 2013/0334952 A1 Dec. 19, 2013

(51) Int. Cl.
*A47B 96/04* (2006.01)

(52) U.S. Cl.
USPC ..... 312/405.1; 312/321.5; 211/153; 211/90.03

(58) Field of Classification Search
USPC ..... 312/405.1, 321.5; 211/153, 211/119.01–119.03, 85.4, 14, 41.4, 119, 211/126.9, 181.1, 74–75, 90.03
See application file for complete search history.

(56) References Cited

U.S. PATENT DOCUMENTS

| | | | | | |
|---|---|---|---|---|---|
| 1,514,375 | A | * | 11/1924 | Crimmel | 211/74 |
| 2,061,453 | A | * | 11/1936 | Crosley, Jr. et al. | 312/199 |
| 2,074,438 | A | | 3/1937 | Swedman | |
| 2,074,785 | A | * | 3/1937 | Mined, Jr. | 108/134 |
| 2,135,878 | A | * | 11/1938 | Sekyra, Sr. | 62/252 |
| 2,743,020 | A | * | 4/1956 | Rubenstein | 211/50 |
| 2,984,533 | A | * | 5/1961 | Sundberg | 312/408 |
| D213,993 | S | * | 4/1969 | Mineo, Jr. | D6/462 |
| 3,487,951 | A | * | 1/1970 | Beltzung | 211/133.2 |
| D280,282 | S | * | 8/1985 | Erbach | D7/404 |
| 5,181,621 | A | * | 1/1993 | Plaehn | 211/88.01 |
| 5,323,917 | A | | 6/1994 | Johnson et al. | |
| 5,379,536 | A | * | 1/1995 | Lorenzana | 38/106 |
| 5,390,443 | A | * | 2/1995 | Emalfarb et al. | 47/67 |
| D430,441 | S | * | 9/2000 | Rosenberg | D6/566 |
| 6,119,876 | A | * | 9/2000 | Lacourse | 211/74 |
| D433,958 | S | * | 11/2000 | Rosenberg | D6/513 |
| D463,188 | S | | 9/2002 | Miller et al. | |
| D479,537 | S | * | 9/2003 | Bodine et al. | D15/89 |
| 6,799,818 | B2 | | 10/2004 | Ahmed et al. | |
| 6,932,449 | B2 | | 8/2005 | Collins et al. | |
| 7,111,914 | B2 | | 9/2006 | Avendano | |
| 7,334,853 | B2 | | 2/2008 | Ahmed et al. | |
| 7,520,397 | B1 | * | 4/2009 | Segale | 211/106 |
| 7,610,774 | B2 | | 11/2009 | Anderson et al. | |

(Continued)

FOREIGN PATENT DOCUMENTS

DE 20207610 U1 10/2002

*Primary Examiner* — Darnell Jayne
*Assistant Examiner* — Ryan A Doyle

(57) ABSTRACT

A storage rack configured to be removably attached to an inner refrigerator door liner to enable storage of canned and/or bottled beverages is defined by an open body formed from a peripheral frame member, a base member fixed to and extending between side portions of the peripheral frame member and an angled support member. A front segment of the angled support member and a frontal section of the peripheral frame member include a series of aligned arcuate portions. Bottles, such as soda, water, wine and the like bottles, can be stored upright in the rack, resting on the base member between the frontal section of the peripheral frame member and a rear segment of the angled support member, while beverage cans can be stored at an angle, abutting the rear segment of the angled support member while spaced side portions of the cans rest upon the aligned arcuate portions.

25 Claims, 2 Drawing Sheets

(56) References Cited

U.S. PATENT DOCUMENTS

| | | | | |
|---|---|---|---|---|
| D614,082 | S * | 4/2010 | Alexander | D11/155 |
| 7,828,160 | B2 | 11/2010 | Lin | |
| 2004/0178711 | A1 * | 9/2004 | Avendano | 312/405.1 |
| 2004/0183417 | A1 * | 9/2004 | Ahmed et al. | 312/408 |
| 2005/0269277 | A1 * | 12/2005 | Su | 211/74 |
| 2006/0207950 | A1 | 9/2006 | Kiehnau et al. | |
| 2008/0000856 | A1 | 1/2008 | Primiano | |
| 2009/0308825 | A1 * | 12/2009 | Lin | 211/181.1 |

* cited by examiner

BEVERAGE STORAGE RACK

BACKGROUND OF THE INVENTION

1. Field of the Invention

The invention generally pertains to a beverage storage rack and, more particularly, to a versatile storage rack which can be removably mounted on the door of a refrigerator for selectively storing cans and/or bottles.

2. Discussion of the Related Art

In a typical household, it is often necessary to refrigerate, in addition to a host of food items, a variety of beverages simultaneously. Of course, it is desirable to organize the beverages in order to minimize the required storage space and to enhance the accessibility of the beverages. For this purpose, it is known to employ a rack in a refrigerator dedicated to house beverages. A rack constructed in accordance with the known prior art is generally configured for use with a single, particularly shaped type of beverage container. For instance, it is common to employ a rack which is adapted to hold a series of 12 ounce cylindrical soft drink cans in a refrigerator, with the cans being automatically fed to a dispensing end of the rack. It is also known to employ a rack to support one or more wine bottles, as well as a rack to support other bottled beverages. In one particularly versatile arrangement as set forth in U.S. Pat. No. 6,932,449, a multi-functional beverage storage rack for a refrigerator is designed to accommodate three different types of beverage containers. More specifically, the rack is configured to alternatively support cylindrical cans, a series of bottles or a single wine bottle.

Although there exists racks which are actually configured to support multiple types of beverage containers, there still is seen to exist a need in the art for a multi-functional beverage rack for a refrigerator which can be used to store varying types of beverage containers simultaneously.

SUMMARY OF THE INVENTION

The invention is directed to a storage rack configured to be removably attached to an inner door liner of a refrigerator. The rack includes structure specifically configured to accommodate the storage of beverage contained in either cans or bottles. In accordance with a preferred embodiment of the invention, the rack is defined by an open body formed from a peripheral frame member, a base member fixed to and extending between side portions of the peripheral frame member and an angled support member. The angled support member is preferably attached to each of the peripheral frame member and the base member, while having front and rear segments. The front segment of the angled support member and a frontal section of the peripheral frame member include a series of aligned arcuate portions, with the arcuate portions of the frontal section of the peripheral frame member being spaced rearward and arranged below a level of the front segment of the angled support member. Projecting from the peripheral frame member are retainer elements for removably mounting the rack upon lugs projecting from opposing side wall portions of a refrigerator inner door liner.

In one form of the invention, each of the peripheral frame member, base member, angled support member and retainer elements are constituted by wires. In any case, with the above construction, the rack can be readily supported on the inner door liner of a refrigerator. Bottles, such as soda, water, wine and the like bottles, can be stored upright in the rack with bottoms of the bottles resting on the base member, lower side wall portions of the bottles being positioned between the frontal section of the peripheral frame member and the rear segment of the angled support member, and higher side wall portions of the bottles extending directly adjacent a rear section of the peripheral frame member. On the other hand, beverage cans can be stored at an angle or sloped fashion, with bottoms of the cans abutting the rear segment of the angled support member, while spaced side portions of the cans rest upon the aligned arcuate portions of the front segment of the angled support member and the frontal section of the peripheral frame member.

Additional objects, features and advantages of the invention will become more readily apparent from the following detailed description when taken in conjunction with the drawings wherein like reference numerals refer to corresponding parts in the several views.

DETAILED DESCRIPTION OF PREFERRED EMBODIMENTS

Figure 1:
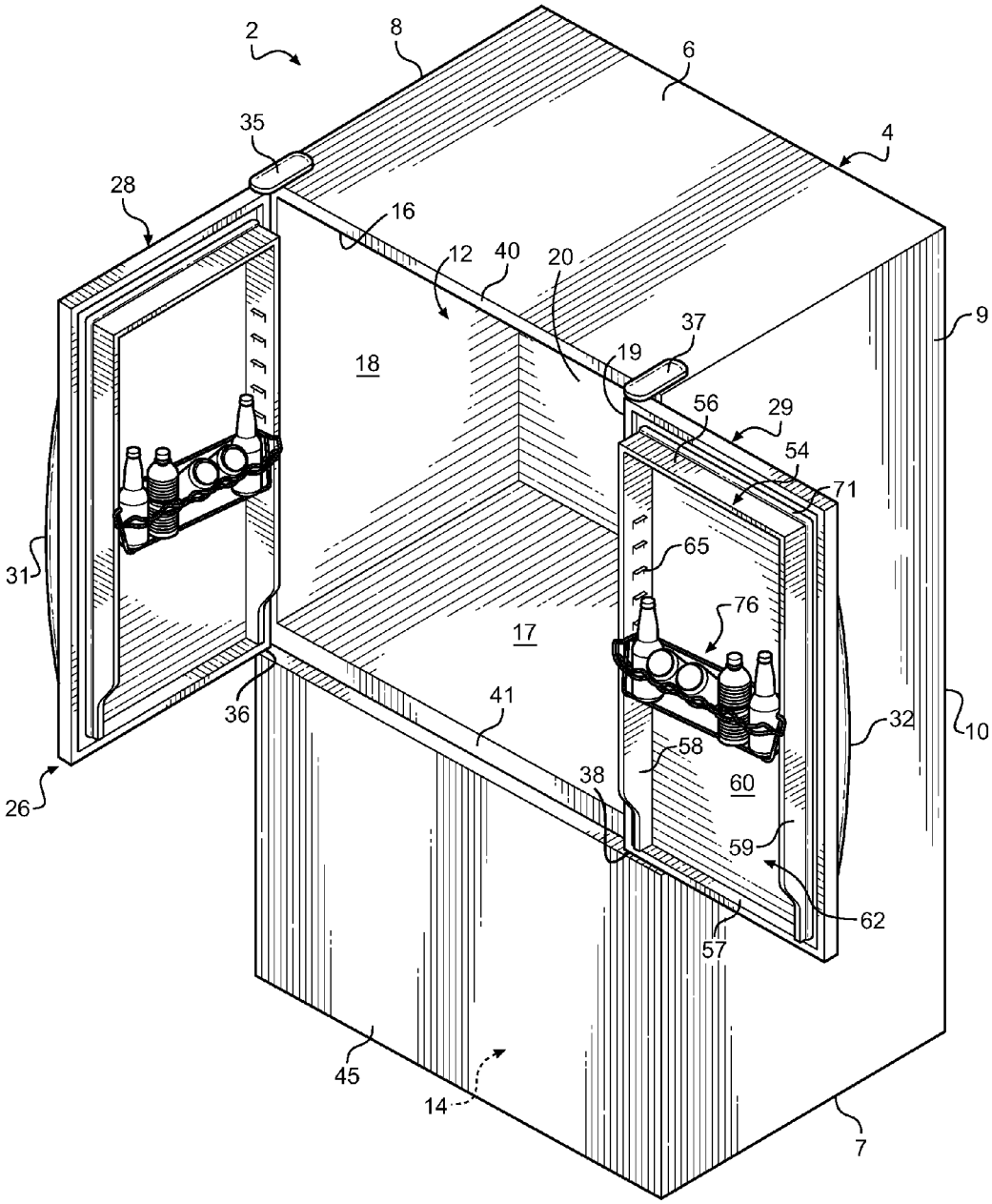
FIG. 1 is a perspective view of a French-style refrigerator including beverage racks constructed in accordance with the invention mounted on inner fresh food compartment door liners.

With initial reference to FIG. 1, a bottom-mount refrigerator constructed in accordance with the present invention is generally indicated at 2. Refrigerator 2 is shown to include a cabinet 4 having a top wall 6, bottom wall 7, opposing side walls 8 and 9 and a rear wall 10 which combine to form first and second compartments 12 and 14. In the embodiment shown, first or fresh food compartment 12 includes a liner having a top portion 16, a bottom portion 17, opposing side wall portions 18 and 19 and a rear wall portion 20. Although not shown, refrigerator 2 includes a refrigeration system establishing above and below freezing temperatures in compartments 12 and 14 respectively. In addition, although shown as an open space in this figure, fresh food compartment 12 would be provided with various shelves and bins for storing a wide range of food products in a manner known in the art.

Refrigerator 2 is provided with an upper door assembly 26 which, in accordance with the invention, is constituted by French-style doors including first and second doors 28 and 29. First and second doors 28 and 29 are provided with respective handles 31 and 32 to enable a consumer to operate doors 28 and 29 in providing access to fresh food compartment 12. Actually, first and second doors 28 and 29 pivot about upper and lower hinges 35 and 36, 37 and 38 respectively. As detailed more fully below, first and second doors 28 and 29 are adapted to selectively seal against upper front face portion 40 and lower front face portion 41 of cabinet 4 to prevent cold air from escaping first or fresh food compartment 12. Actually, first and second doors 28 and 29 also seal against side portions of cabinet 4 (not separately labeled). Finally, a lower or freezer door 45 is provided to enable access to the second or freezer compartment 14. In the embodiment shown, refrigerator 2 is a bottom mount configuration with lower freezer door 45 being adapted to slide in and out of cabinet 4 to provide access to frozen goods located within second compartment 14. However, as will become more fully evident below, the invention has a wide range of applications, including top mount and other style refrigerators.

Except as identified below, the structure of each door 28, 29 is substantially identical. Therefore, a detailed description of the basic structure of door 29 will be made and it is to be understood that door 28 has commensurate structure. As shown, a liner 54 is depicted as having an outwardly projecting top portion 56, bottom portion 57, opposing side portions 58 and 59 and a rear portion 60 which collectively define a storage cavity 62. In a manner known in the art, storage cavity 62 is provided with a plurality of shelf support elements or lugs, one of which is indicated at 65 on side portion 58. However, it should be understood that a corresponding plurality of shelf support elements (not shown) are provided on opposing side portion 59 such that the shelf support elements 65 are arranged in pairs. In any event, shelf support elements 65 are adapted to receive a variety of shelf members, i.e., adjustable shelves, bins, storage units and the like, for retaining goods such as butter, soda and the like on door 29. Liner 43 is also provided with a flexible gasket 71 which extends along multiple door sides of door 29 and is used, in conjunction with other mullion sealing structure (not shown), in providing an air-tight seal for fresh food compartment 12 when doors 28 and 29 are closed. Again, the liner for door 28 is identically constructed to that described above.

Figure 2:
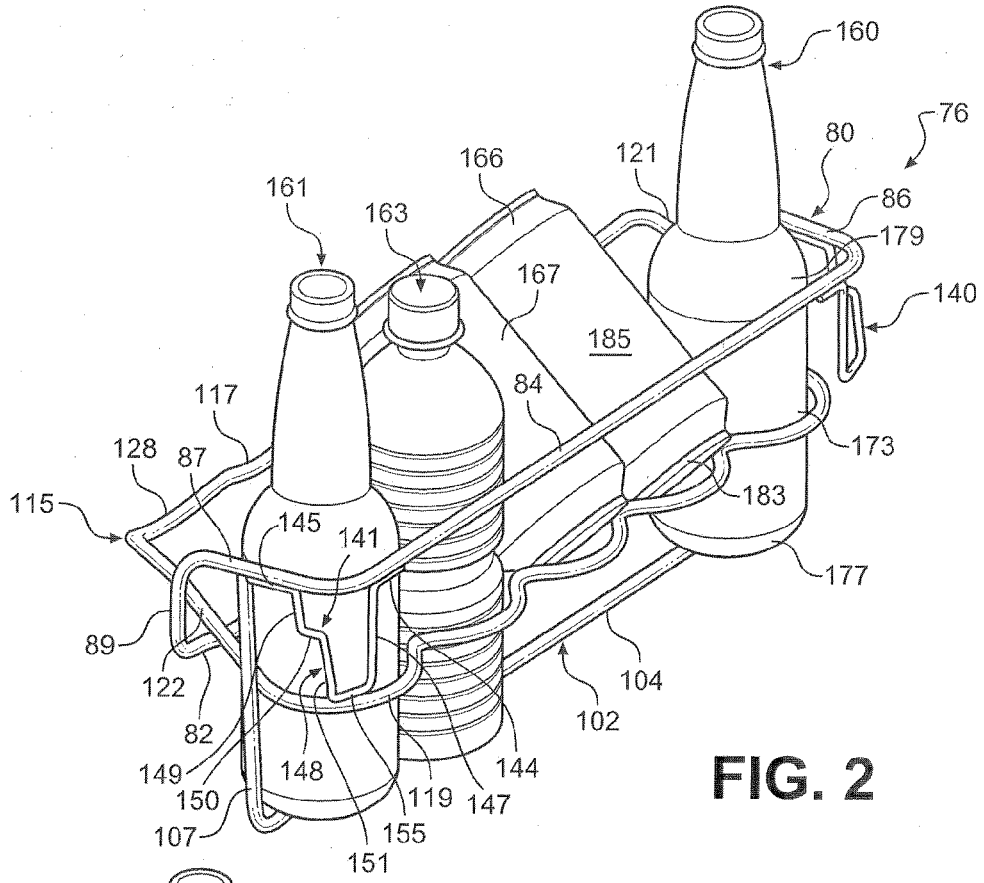
FIG. 2 is right rear perspective view of the beverage rack of the invention.
Figure 3:
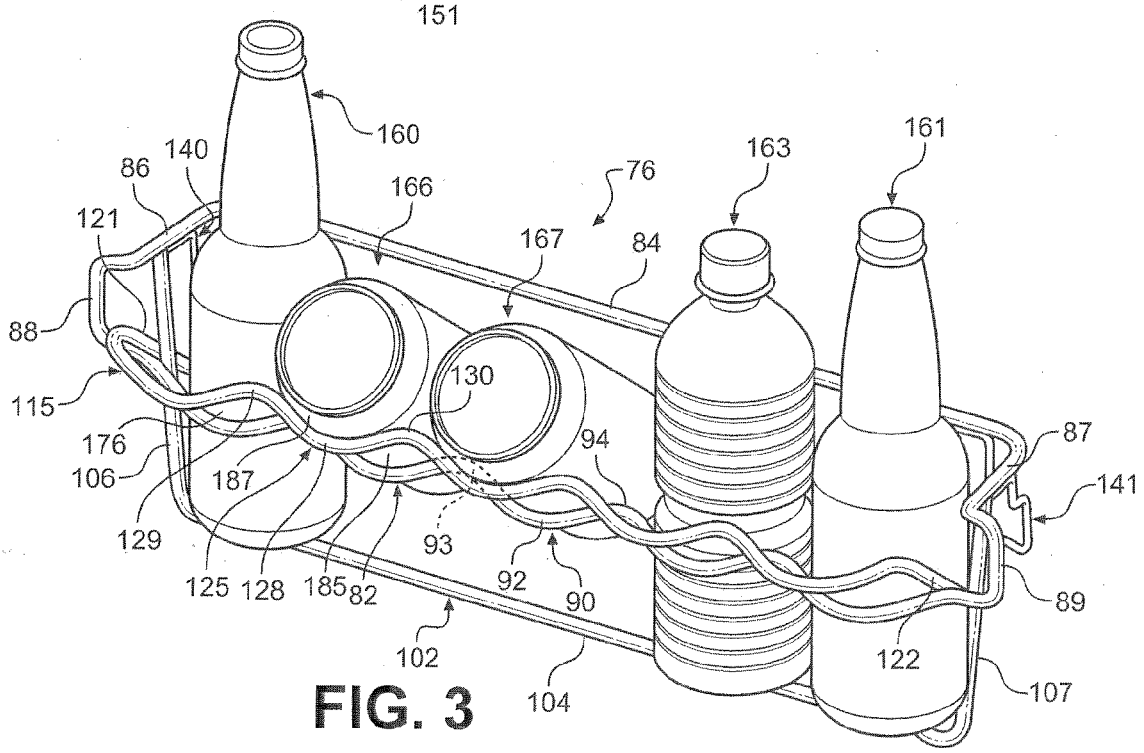
FIG. 3 is an upper right perspective view of the beverage rack of the invention.

In general, the above-described structure of refrigerator 2 is known in the art and merely provided for the sake of completeness. Instead, the present invention is particularly directed to the structure and incorporation of a beverage storage rack for either or both of doors 28 and 29 as generally indicated at 76. As best shown in FIGS. 2 and 3, beverage storage rack 76 is defined by an open body formed from a peripheral frame member 80 including a frontal section 82, a rear section 84, side portions 86 and 87, and down-turned portions 88 and 89. In the preferred embodiment shown, peripheral frame member 80 is formed of wire which is bent and connected at ends in order to establish an overall loop. As also shown in these figures, frontal section 82 is defined by a series of arcuate portions 90, each one of which is defined by a trough region 92 arranged between a pair of spaced crest regions 93 and 94.

In addition to peripheral frame member 80, beverage storage rack 76 includes a base member 102. As shown, base member 102 is also preferably formed of wire and includes a lower crossbar 104 which interconnects a pair of upright side members 106 and 107. Upper terminal ends (not separately labeled) of upright side members 106 and 107 are fixedly secured to and extend from side portions 86 and 87 of peripheral frame 80. With this arrangement, base member 102 is arranged between frontal section 82 and rear section 84 of peripheral frame member 80, with lower crossbar 104 being located entirely below peripheral frame member 80.

Beverage storage rack 76 further includes an angled support member generally indicated at 115. As shown, angled support member 115 includes a front segment 117, a rear section 119, and side segments 121 and 122 which interconnect front segment 117 to rear segment 119. As shown, angled support member 115 also constitutes a wire which takes the form of a loop. As depicted, front segment 117, in a manner similar to frontal section 82 of peripheral frame member 80, is provided with a series of arcuate portions 125 which are aligned with the series of arcuate portions 90 of peripheral frame member 80. Also in a similar manner, each of the series of arcuate portions 125 is defined by a trough region 128 arranged between respective crest regions 129 and 130. Angled support member 115 is preferably attached to each of peripheral frame member 80 and base member 102. More specifically, side segment 121 is attached to each of frontal section 82 of peripheral frame member 80 and upright side member 106 of base member 102, while side segment 122 of angled support member 115 is attached to down-turn portion 89 of side portion 87 of peripheral frame member 80 and to upright side member 107 of base member 102. In accordance with one preferred embodiment of the invention, rear segment 119 of angled support member 115 includes a similarly configured series of arcuate portions (not separately labeled). However, at this point, it should be noted, in accordance with other preferred embodiments of the invention, rear segment 119 of angled support member 115 is constituted by a generally linear rod. In any case, angled support member 115 is positioned such that the series of arcuate portions 90 of peripheral frame member 80 is spaced rearward and arranged below a level of front segment 117 of angled support member 115. In addition, rear segment 119 of angled support member 115 is arranged below both front segment 117 of angled support member 115 and frontal section 82 of peripheral frame member 80.

As indicated above, beverage storage rack 76 is configured to be supported from either or both of doors 28 and 29 of refrigerator 2. For this purpose, beverage storage rack 76 includes a pair of spaced retainer elements 140 and 141. As each retainer element 140, 141 is similarly constructed, a detailed discussion of the preferred structure for retainer element 141 will now be described and it should be understood that retainer element 140 has corresponding structure. As shown, retainer element 141 also takes the form of a wire having a pair of terminal attachment arms 144 and 145. As shown, attachment arm 144 is secured, such as by welding, to rear section 84 of peripheral frame member 80 and attachment arm 145 is secured to side portion 87 of peripheral frame member 80. Depending from attachment arm 144 is a first down-turned leg 147, while a second down-turned leg 148 extends from attachment arm 145. As shown, second down-turned leg 148 includes a first section 149, a second, angled section 150, and a third section 151 which leads to a connecting leg 155 that extends between first and second down-turned legs 147 and 148.

With the above construction, beverage storage rack 76 can be removably hung from a respective pair of the shelf support element 65, with each support element 65 becoming positioned between a respective side member 106, 107 and the first section 149 of a respective second down-turned leg 148 of the retainer elements 140 and 141. At the same time, portions of retainer elements 140 and 141 will abut against rear portion 60 of liner 54. More specifically, rear portion 60 will be abutted by rear section 84 of peripheral frame member 80, as well as first down-turned leg 80, third section 151 of second down-turned leg 148, and connecting leg 155 of each retainer element 140, 141. In addition, down-turned portions 88 and 89 of peripheral frame member 80 extend about side portions 58 and 59 of liner 54 as shown in FIG. 1. This overall engagement provides structural stability for beverage storage rack 76 on a respective door 28, 29 and prevents relative rotation of beverage rack 26 and the door 28, 29 even upon the forces exerted thereon when opening and closing of doors 28 and 29. In addition, this construction for beverage storage rack 76 also enables a wide range of containers to be conveniently stored and displayed on beverage storage rack 76. In particular, each of these figures shows various types of containers as exemplified by a pair of spaced glass bottles 160 and 161, a plastic bottle 163, and cans 166 and 167 supported at varies locations along beverage storage rack 76. More specifically, in the case of bottle 160, beverage storage rack 76 enables bottle 160 to be stored in an upright manner with a bottom 177 of bottle 160 resting upon lower crossbar 104 of base member 102. Therefore, this first type of container is stored in an upright configuration, with a lower rear side portion 173 being positioned directly adjacent rear segment 119 of angled support member 115 (see FIG. 2), an intermediate front side portion 176 being positioned directly adjacent frontal section 82 of peripheral frame member 80 (see FIG. 3), and an upper rear side portion 179 of bottle 160 extending directly adjacent rear section 84 of peripheral frame member 80 (see FIG. 2). As should be readily evident, this overall first type of container support arrangement encompasses both bottles 160 and 161, as well as bottle 163. Given the presence of the series of arcuate portions 90 provided on peripheral frame member 80, at least the front portion (not separating labeled) of the first type of containers are conformingly received within beverage storage rack 76. In addition, at least in the embodiment wherein rear segment 119 of angled support member 115 also includes a series of arcuate portions 125, each of the first type of containers are also conformingly received in rear portions thereof. When supporting a second type of container, such as cans 166 and 167, a bottom 183 of the can 166, 167 abuts rear segment 119 of angled support member 115, while spaced side portions 185 rest upon the aligned series of arcuate portions 90 and 125 established on frontal section 82 of peripheral frame member 80 and front segment 117 of angled support member 115 respectively. Given that the second type of container is generally cylindrical, the side portions 185 rest in the respective trough regions 92 and 128. In addition, given the varying vertical height between rear segment 119, frontal section 82 and front segment 117, the cans 166 and 167 slope upwardly from the respective bottoms 183 to tops 187 thereof.

Based on the above, it should be readily apparent that the beverage storage rack of the present invention provides a versatile way in which to support a variety of different types of containers in both vertical and angled orientations, with the containers ranging from wine and other bottle beverages, to water and other plastic bottle beverages, and can beverages. Certainly, it should readily apparent that the spacing provided to accommodate the various types of containers could be readily altered, while a single spacing would accommodate a majority of standard sized beverage containers available on the market today. In any case, although described with respect to preferred embodiments of the invention, it should be readily understood that various changes and/or modifications can be made to the invention without departing from the spirit thereof. For instance, although the beverage storage rack is preferably made from bending and interconnecting wires, it could be made from other materials, such as plastic, and in other ways, such through a molding operation or by interconnecting separate pieces together. In general, the invention is only intended to be limited by the scope of the following claims.

What is claimed is:

1. A refrigerator comprising:

a cabinet including a first compartment and an opening for receiving items to be refrigerated;

a door shiftably mounted relative to the cabinet for selectively accessing the first compartment; and a beverage storage rack mounted on the door and including:

a peripheral frame member having spaced side portions interconnected by a frontal section and a rear section;

a base member fixed to and extending below and between the side portions of the peripheral frame member; and an angled support member interconnected to the peripheral frame member and the base member, said angled support member including front and rear segments, with the front segment of the angled support member and the frontal section of the peripheral frame member including a series of aligned arcuate portions, with the arcuate portions of the frontal section of the peripheral frame member and the front segment of the angled support member being spaced in a fore-to-aft direction and arranged at different heights, wherein:

a) the beverage storage rack is configured to support a first type of container in an upright configuration with a bottom of the first type of container resting on the base member, lower side portions of the first type of container being positioned between the frontal section of the peripheral frame member and the rear segment of the angled support member, and an upper side portion of the first type of container extending adjacent a rear section of the peripheral frame member; and b) the beverage storage rack configured to support a second type of container in an angled configuration with a bottom of the second type of container abutting the rear segment of the angled support member, while spaced side portions of the second type of container rest upon the aligned arcuate portions of the front segment of the angled support member and the frontal section of the peripheral frame member.

2. The refrigerator according to claim 1, wherein the peripheral frame takes the form of a loop formed from the frontal section being interconnected to the rear section through the spaced side portions.

3. The refrigerator according to claim 1, wherein the frontal section of the peripheral frame is arranged rearward of the front segment of the angled support member.

4. The refrigerator according to claim 3, wherein the frontal section of the peripheral frame is arranged below a level of the front segment of the angled support member.

5. The refrigerator according to claim 1, wherein the base member includes a lower crossbar extending between upright side members.

6. The refrigerator according to claim 5, wherein each of the upright side members is directly attached to each of the peripheral frame member and the angled support member.

7. The refrigerator according to claim 6, wherein the upright side members terminate at the side portions of the peripheral frame member.

8. The refrigerator according to claim 1, wherein the angled support member takes the form of a loop formed from the front and rear segments being joined by side segments.

9. The refrigerator according to claim 8, wherein each of the side segments of the angled support member is directly attached to both the peripheral frame member and the base member.

10. The refrigerator according to claim 9, wherein the rear segment of the angled support member is formed with a series of arcuate portions.

11. The refrigerator according to claim 1, further comprising:

a plurality of vertically spaced shelf support elements arranged in pairs on the door; and a pair of spaced retainer elements provided on the beverage storage rack for adjustably mounting the beverage storage rack to a selective pair of the plurality of vertically spaced shelf support elements.

12. A beverage storage rack for mounting on a refrigerator door comprising:

a peripheral frame member having spaced side portions interconnected by a frontal section and a rear section;

a base member fixed to and extending below and between the side portions of the peripheral frame member; and an angled support member interconnected to the peripheral frame member and the base member, said angled support member including front and rear segments, with the front segment of the angled support member and the frontal section of the peripheral frame member including a series of aligned arcuate portions, with the arcuate portions of the frontal section of the peripheral frame member and the front segment of the angled support member being spaced in a fore-to-aft direction and arranged at different heights, wherein:

a) the beverage storage rack is configured to support a first type of container in an upright configuration with a bottom of the first type of container resting on the base member, lower side portions of the first type of container being positioned between the frontal section of the peripheral frame member and the rear segment of the angled support member, and an upper side portion of the first type of container extending adjacent a rear section of the peripheral frame member; and b) the beverage storage rack is configured to support a second type of container in an angled configuration with a bottom of the second type of container abutting the rear segment of the angled support member, while spaced side portions of the second type of container rest upon the aligned arcuate portions of the front segment of the angled support member and the frontal section of the peripheral frame member.

13. The beverage storage rack according to claim 12, wherein the peripheral frame takes the form of a loop formed from the frontal section being interconnected to the rear section through the spaced side portions.

14. The beverage storage rack according to claim 12, wherein the frontal section of the peripheral frame is arranged rearward of the front segment of the angled support member.

15. The beverage storage rack according to claim 14, wherein the frontal section of the peripheral frame is arranged below a level of the front segment of the angled support member.

16. The beverage storage rack according to claim 12, wherein the base member includes a lower crossbar extending between upright side members.

17. The beverage storage rack according to claim 16, wherein each of the upright side members is directly attached to each of the peripheral frame member and the angled support member.

18. The beverage storage rack according to claim 17, wherein the upright side members terminate at the side portions of the peripheral frame member.

19. The beverage storage rack according to claim 12, wherein the angled support member takes the form of a loop formed from the front and rear segments being joined by side segments.

20. The beverage storage rack according to claim 19, wherein each of the side segments of the angled support member is directly attached to both the peripheral frame member and the base member.

21. The beverage storage rack according to claim 20, wherein the rear segment of the angled support member is formed with a series of arcuate portions.

22. The beverage storage rack according to claim 12, further comprising:

a pair of spaced retainer elements provided on the beverage storage rack for adjustably mounting the beverage storage rack to a selective pair of a plurality of vertically spaced shelf support elements provided on a refrigerator door.

23. A method of storing first and second distinct types of containers on a beverage storage rack comprising:

supporting the first type of container in an upright configuration with a bottom of the first type of container resting on a base member of the beverage storage rack, lower side portions of the first type of container being positioned between a frontal section of a peripheral frame member of the beverage storage rack and a rear segment of an angled support member interconnected to the peripheral frame member and the base member of the beverage storage rack, and an upper side portion of the first type of container extending adjacent a rear section of the peripheral frame member; and supporting the second type of container in an angled configuration with a bottom of the second type of container abutting the rear segment of the angled support member, while spaced side portions of the second type of container rest upon aligned fore-to-aft spaced and varying height arcuate portions of a front segment of the angled support member and the frontal section of the peripheral frame member.

24. The method of claim 23, further comprising: situating the first type of container at the rear segment of the angled support member at a position lower than at the frontal section of the peripheral frame.

25. The method of claim 23, further comprising: inserting the first and second types of containers into or removing the first and second types of containers from the beverage storage rack while the beverage storage rack is mounted on a door of a refrigerator.

* * * * *